United States Patent [19]

Simonelic et al.

[11] Patent Number: 4,932,579

[45] Date of Patent: Jun. 12, 1990

[54] STAPLING APPARATUS WITH STACK JOGGERS

[75] Inventors: George B. Simonelic; Casper W. Hagemann; Larry A. Sikora; Norman E. Andersen; Bernard P. Kunka, all of Racine, Wis.

[73] Assignee: The Interlake Companies, Inc., Oak Brook, Ill.

[21] Appl. No.: 327,755

[22] Filed: Mar. 23, 1989

[51] Int. Cl.[5] ..... B27F 7/21; B65H 29/46

[52] U.S. Cl. ..... 227/5; 227/49; 227/50; 227/89; 227/102; 227/104; 270/30; 270/53

[58] Field of Search ..... 227/3, 4, 5, 6, 7, 39, 227/40, 49, 50, 84, 89, 104, 111, 105, 100, 102, 99; 271/221; 270/37, 30, 31, 53, 54

[56] References Cited

U.S. PATENT DOCUMENTS

| | | | |
|---|---|---|---|
| 705,198 | 7/1902 | Bowman | 271/221 |
| 1,132,990 | 3/1915 | Weber | 227/89 |
| 1,226,170 | 5/1917 | Baumann | 227/89 X |
| 1,252,011 | 1/1918 | Maynard | 227/89 X |
| 1,949,764 | 3/1934 | Schreiber et al. | 271/221 |
| 2,393,254 | 1/1946 | Leifer | 271/221 X |
| 2,987,729 | 6/1961 | Taynton | 227/89 |
| 3,193,284 | 7/1965 | Kretz, Jr. | 270/53 |
| 3,265,274 | 8/1966 | Barnell | 227/50 X |
| 3,642,187 | 2/1972 | Barland | 227/84 |
| 4,346,882 | 8/1982 | Pessina et al. | 271/221 |

*Primary Examiner*—Hien H. Phan
*Assistant Examiner*—Rinaldi Rada
*Attorney, Agent, or Firm*—Emrich & Dithmar

[57] ABSTRACT

A transport table reciprocates between a collator, at which it receives a stack of loose sheets, and a stapling head for stapling the sheets together. Cam followers on the table engage cam surfaces during the reciprocating table movement to cause jogging movements of end and side retaining means to jog the loose sheets into a neat stack. The stack is delivered into a gap between the stapling head and an anvil, and the stapling head moves through a first half cycle, forming a staple and clamping the stack. A gate on the transport table lifts to free the stack while the table retracts, and then the stapling head drives the staple through the stack. The gate lowers when the transport table returns to its original position.

21 Claims, 8 Drawing Sheets

STAPLING APPARATUS WITH STACK JOGGERS

BACKGROUND OF THE INVENTION

1. The Field of the Invention

The present invention relates to stitching or stapling apparatus, and in particular to apparatus for forming and driving a wire staple through a stack of sheet material, such as paper.

2. Description of the Prior Art

Stitching or stapling machines are well known and are sold, for example, by Interlake Packaging Corp. under the trademark "CHAMPION STITCHER". Such machines are disclosed, for example, in U.S. Pat. No. 1,252,011. It is known to utilize such stitching or stapling machines in conjunction with duplicating, collating or other types of paper handling devices for stapling together stacks of paper sheets generated at the output of such devices.

One of the difficulties in such applications is arranging the stack of loose sheets and positioning it at the stapling region in a neat stack with the edges of adjacent sheets vertically aligned. While there have been provided copying machines or the like with built-in stapling devices, there has not been provided a simple and effective stand-alone stapling apparatus which can conveniently be used in conjunction with an associated rotary collating machine for receiving and stapling the output thereof.

SUMMARY OF THE INVENTION

It is a general object of this invention to provide an improved wire stapling apparatus which avoids the disadvantages of prior devices while affording additional structural and operating advantages.

An important feature of the invention is the provision of a wire stapling apparatus which is uniquely adapted for use in conjunction with a collating machine for receiving and stapling the output therefrom.

In connection with the foregoing feature, it is another feature of the invention to provide a wire stapling apparatus of the type set forth which delivers a stack of loose sheets in a neat stack to the stapling mechanism.

Another feature of the invention is the provision of a stapling apparatus of the type set forth, which automatically delivers stapled stacks to a collection bin.

Yet another feature of the invention is the provision of a combination of the wire stapling apparatus of the type set forth with an associated collator.

These and other features of the invention are attained by providing a wire stapling apparatus for forming a length of wire into a staple and driving it through a stack of sheets, the apparatus comprising: a clincher anvil; a stapling head spaced a predetermined distance from the anvil and cooperating therewith to define a gap therebetween; and transport means for delivering a stack of loose sheets to a stapling location with at least a portion of the stack disposed in the gap; the head including forming means movable between retracted and forming positions for forming a length of wire into a generally inverted U-shaped staple, the forming means in its forming position cooperating with the anvil firmly to clamp the stack of sheets therebetween, staple driving means movable between retracted and stapling positions for driving the associated staple through the stack of sheets and into engagement with the anvil, motive means for moving the forming means between its retracted, and forming positions and for moving the staple driving means between its retracted and stapling positions, and control means coupled to the motive means for controlling the operation thereof, the control means delaying the movement of the staple driving means to its stapling position for a predetermined time period after movement of the forming means to its forming position and thereafter moving the forming means and the staple driving means back to their retracted positions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
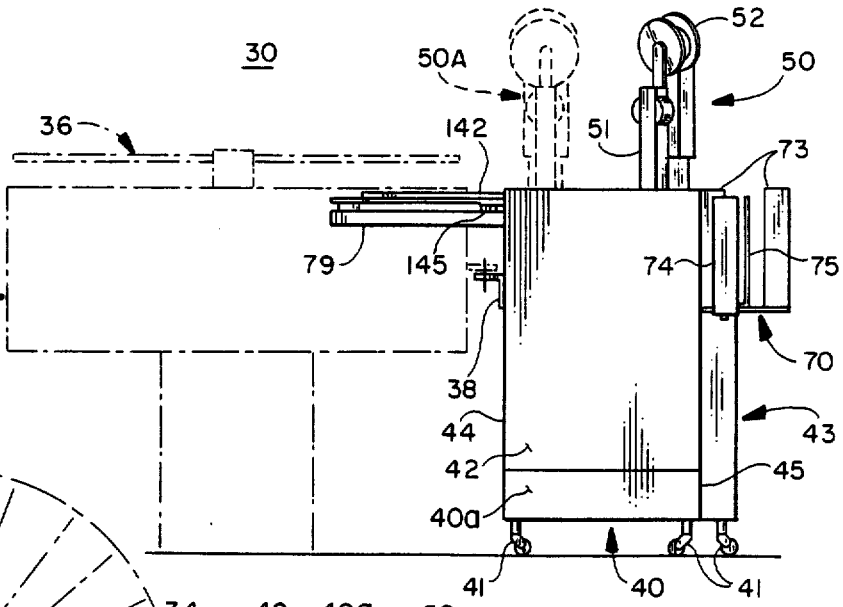
FIG. 1 is a side elevational view of a stapling system in accordance with the present invention, shown in combination with an associated rotary collator.
Figure 2:
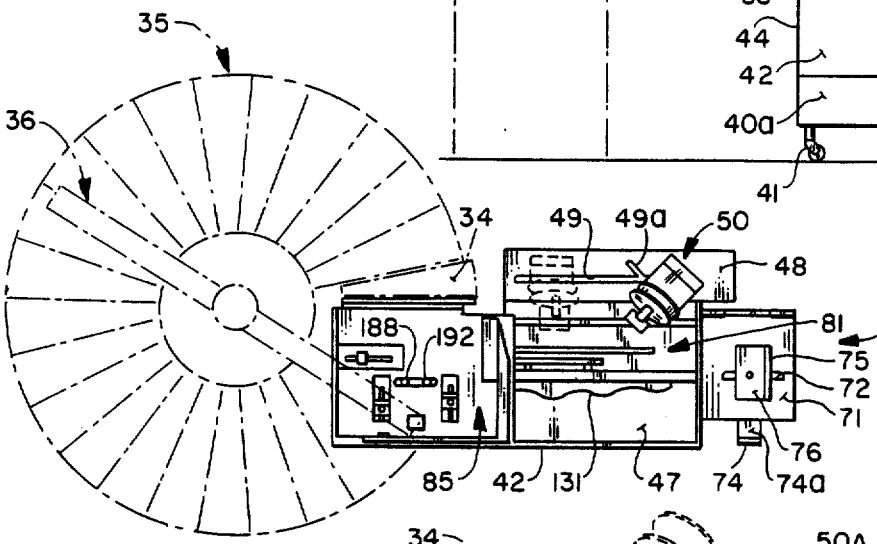
FIG. 2 is a top plan view of the combination illustrated in FIG. 1.
Figure 3:
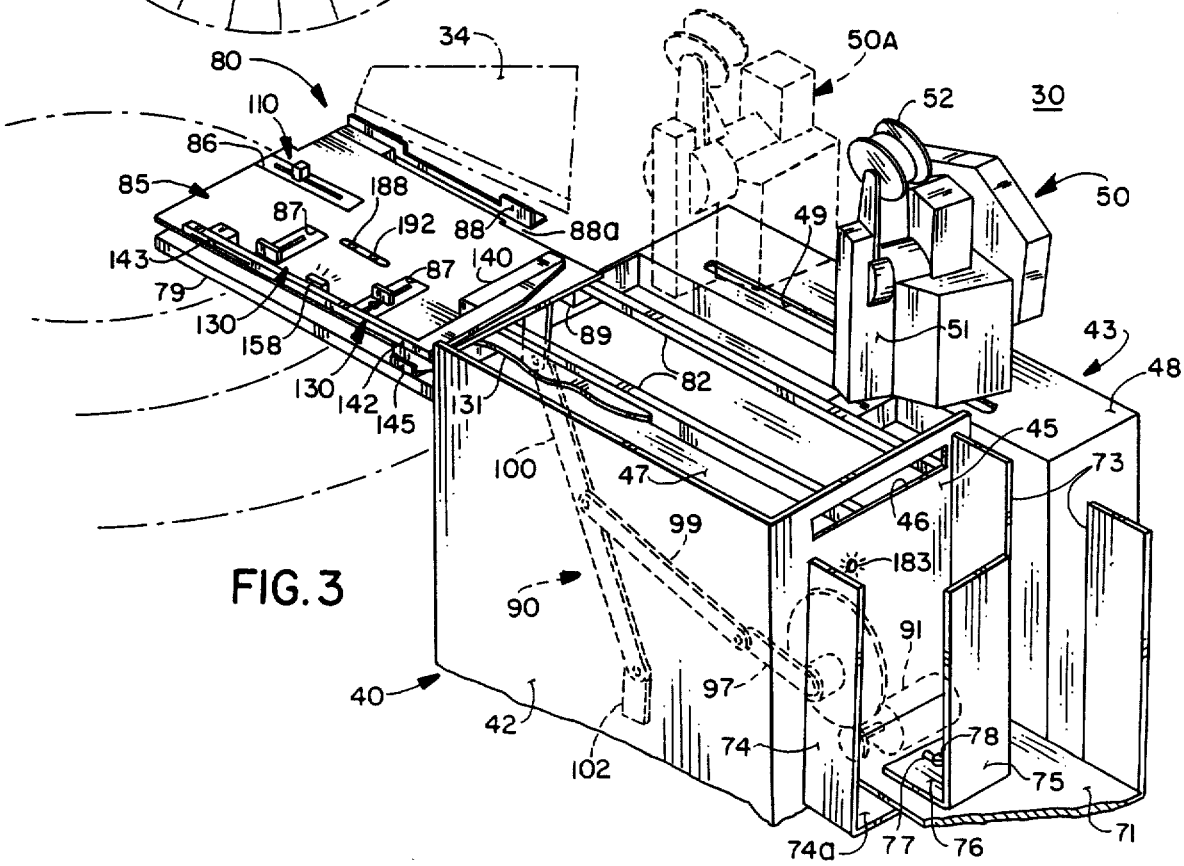
FIG. 3 is an enlarged, fragmentary, perspective view of the combination of FIGS. 1 and 2.

Referring to FIGS. 1–3, there is illustrated a stapling system, generally designated by the numeral 30, constructed in accordance with and embodying the features of the present invention. The stapling system 30 is adapted for receiving stacks 31 of loose sheets 32 of paper or the like (see FIGS. 18–22) from an associated collator 35. The preferred embodiment of the invention illustrated in the drawings is specifically adapted for use with a rotary collator 35 of the type manufactured by Watkiss Automation Ltd., of Bedfordshire, England and sold in the United States by the Challenge Machinery Company, of Grand Haven, Mich. This type of collator has a number of bins arranged in a circle, and a rotating arm 36, which picks up individual sheets from selected bins and forms them into a collated stack for delivery to associated equipment, such as the stapling system 30 of the present invention, via a delivery chute 34. The stapling system 30 is adapted to form wire staples 37 (see FIGS. 4, 25 and 26), and drive them through the stack 31.

The collator 35 is mechanically coupled to the stapling system 30 by a coupling 38 which accurately positions the units with respect to each other. The stapling system 30 is housed in a cabinet 40 which has a plurality of support casters 41 which rest on the underlying floor or support surface 39 and are threadedly adjustable in a known manner to vary the height of the cabinet 40. The cabinet 40 is generally box-like in shape, having a front wall 42, a rear wall on which is mounted a rectangular control box 43, an entry end wall 44 and an exit end wall 45. The upper edge of the entry end wall 44 is lower than the upper edges of the front wall 42 and the exit end wall 45, the latter having a rectangular slot 46 formed therein adjacent to the upper end thereof. The cabinet 40 has a top wall 47 recessed below the upper edges of the front wall 42 and the exit end wall 45 and at substantially the level of the upper edge of the entry end wall 44. The control box 43 has a top wall 48 which is disposed a slight distance above the top wall 47 of the cabinet 40 and is provided with an elongated slot 49 therein having a curved spur portion 49*a* extending therefrom (see FIG. 2). The cabinet 40 may be provided with a detachable bottom section 40*a* to permit a coarse height variation.

Mounted on the top wall 48 of the control box 43 is at least one stitching machine, generally designated by the numeral 50. An auxiliary stitching machine, similar to the stitching machine 50, may also be provided, and is indicated in phantom by the numeral 50A. The stitching machine 50 is of substantially standard construction, and may be of the type which is manufactured by Interlake Packaging Corp. under the trade name "CHAMPION STITCHER". This prior stitcher is, in turn, an improvement of the standard stitching machine disclosed, for example, in U.S. Pat. No. 1,252,011 and, therefore, the details of the operation and construction thereof will not be described herein.

Referring now also to FIGS. 25–28, the stitching machine 50 has a stitching head 51 mounted at the front end thereof, and is further provided with a supply coil 52 of stitching wire, which is fed down through the stitching head 51. During each cycle of operation of the stitching head 51, a length of the stitching wire is fed through a wire holder 54 (see FIG. 25), is cut to provide a cut length 53 which is then rotated to a horizontal position (see FIG. 25). A channel-shaped former 55 &hen is lowered down over the wire holder 54 to bend the ends of the cut length of wire 53 into a substantially inverted U-shaped staple 37. A staple driver 56 is then lowered to engage the bight portion of the staple 37, picking it out of the wire holder 54 and driving the staple 37 through an associated workpiece (such as the stack 31 of sheets), and against an anvil 69 which bends in the legs of the staple in a known manner (see FIG. 26).

Figure 27:
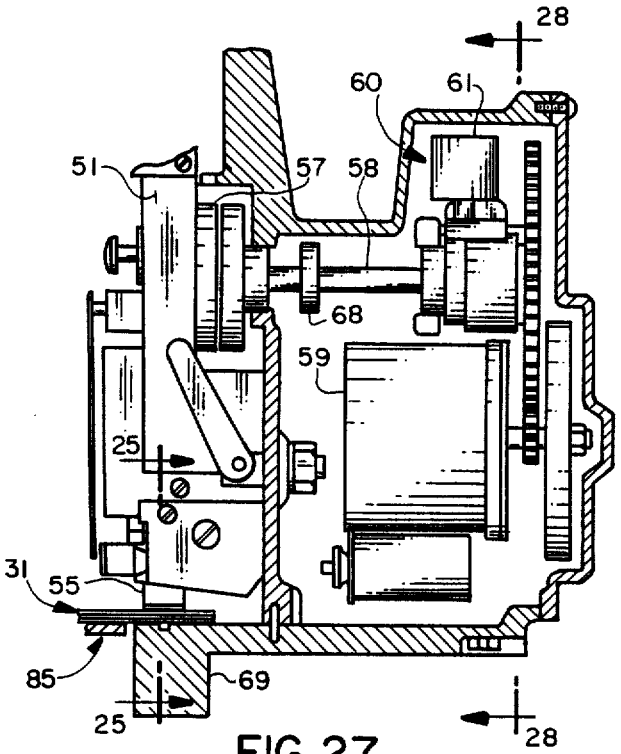
FIG. 27 is an enlarged, fragmentary view in vertical section of one of the stitching machines of the stapling system of FIGS. 1–3, illustrating the drive mechanism thereof.
Figure 28:
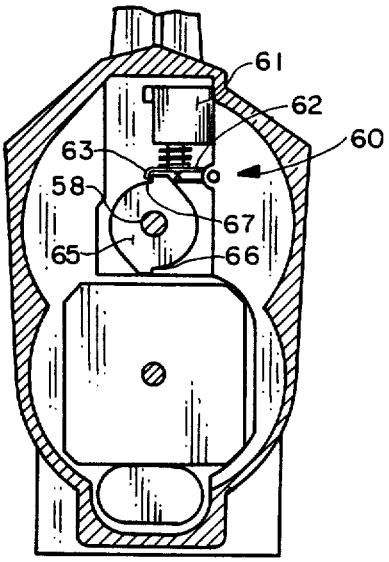
FIG. 28 is a fragmentary view in vertical section taken along the line 28—28 in FIG. 27.

Referring to FIGS. 27 and 28, the former 55 and staple driver 56 of the stitching machine head 51 are reciprocated vertically by linkage 57 which is, in turn, coupled to a rotating shaft 58, which is driven by a drive motor 59 through an associated gear train and a clutch assembly 60. The clutch assembly 60 is a wrap-spring type clutch which is controlled by a solenoid 61 which, when actuated, lifts an actuator bar 62 having a curved lip 63. An actuator collar 65 is fixedly mounted on the shaft 58 and is provided with a pair of diametrically opposed, radially outwardly extending tangs 66 and 67 disposed for engagement with the lip 63 of the actuator bar 62 when the solenoid 61 is deenergized.

In operation, the output shaft of the motor 59 is continuously rotating and drives, through the gear train, a continuously rotating stub shaft (not shown) associated with the clutch assembly 60. When it is desired to engage the clutch assembly 60 to rotate the shaft 58, the solenoid 61 is momentarily actuated, lifting the actuator bar 62 to release the actuator collar 65, which begins to rotate under the urging of the wrap spring. As soon as the collar 65 starts to rotate the clutch is engaged and the shaft 58 rotates. After the shaft is rotated 180 degrees, the other tang 66 of the actuator collar 65 engages the lip 63 of the actuator bar 62 to stop the rotation of the collar 65, thereby releasing the clutch and stopping the rotation of the shaft 58 until the solenoid 61 is again actuated.

A complete cycle of the stitching head 51 comprises a 360 degree rotation of the shaft 58. During the first half cycle the former 55 is moved from its raised, retracted position (not shown) to the forming position illustrated in FIG. 25, in which position the former 55 cooperates with the anvil 69 to clamp the stack 31 of sheets 32 therebetween, as will be explained more fully below. During the second half cycle, which is initiated by another actuation of the solenoid 61, the staple driver 56 drives the staple 37 through the stack 31 (FIG. 26) and the former 55 and the staple driver 56 are retracted to their original positions.

The stitching machine 50A is substantially identical to the stitching machine 50, except that its actuator collar 65 has only a single tang 67 thereon. Thus, each time the solenoid 61 is actuated, the shaft 58 will go through a complete 360 degree revolution, driving the stitching head through a complete cycle, as will be explained in greater detailed below.

Referring to FIGS. 3 and 18–22, there is mounted on the exit end wall 45 of the cabinet 40 a collecting bin 70 which has a flat, rectangular bottom wall 71 provided with an elongated slot 72 therein centrally thereof. Integral with the bottom wall 71 and extending vertically upwardly therefrom are two spaced-apart side walls 73 along one side edge of the bottom wall 71. A single upstanding side wall 74 is provided along the opposite side edge of the bottom wall 71 and has a horizontal bottom flange 74a which extends beneath the bottom wall 71 and is provided with an elongated slot (not shown) therein. An upstanding end wall 75 is provided with a horizontal attachment flange 76 having an aperture 77 therethrough for receiving a suitable fastener 78 which also passes through the slot 72 and the slot in the side wall flange 74a for securely fastening the side wall 74 and the end wall 75 to the bottom wall 71. The slot 72 permits adjustment of the position of the side wall 74 and the end wall 75 toward and away from the exit end wall 45, while the slot in the flange 74a permits adjustment of the side wall 74 laterally inwardly and outwardly of the bottom wall 71, to accommodate different size sheets.

Figure 8:
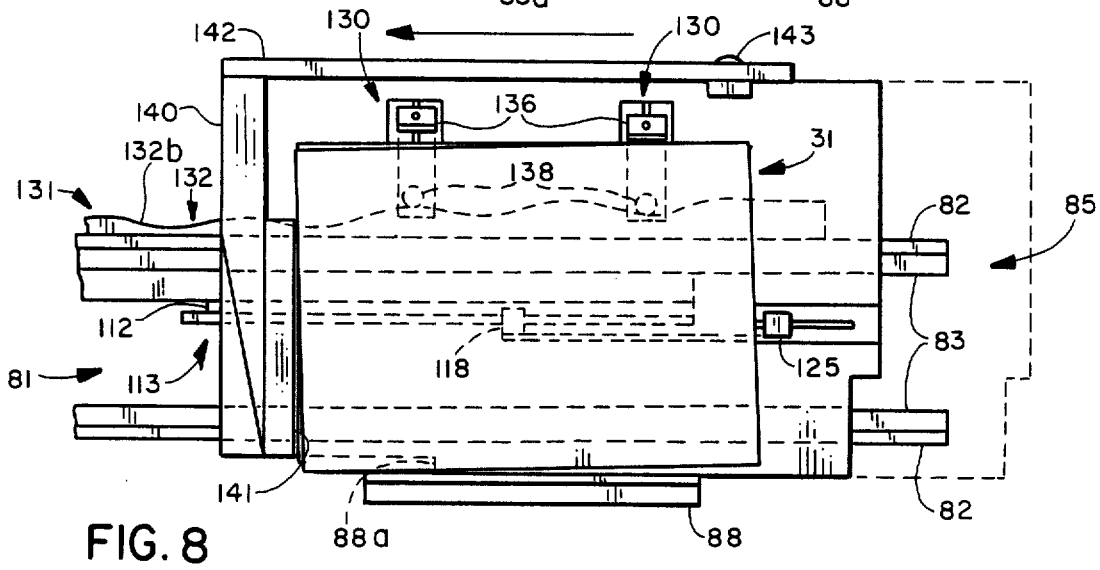
FIG. 8 is a view similar to FIG. 7, illustrating the transport table between its home and stitching positions.
Figure 9:
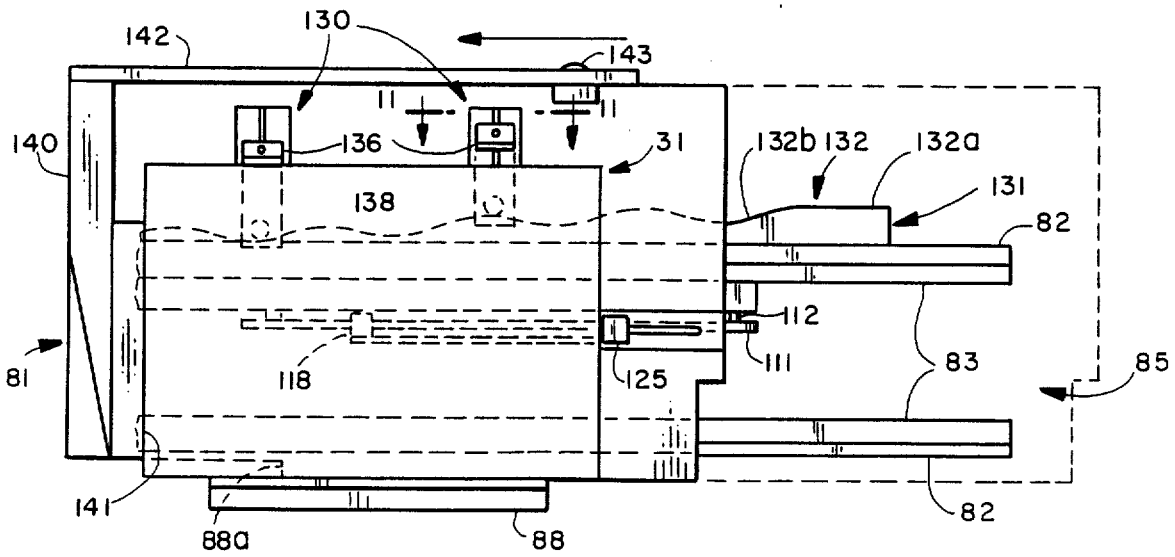
FIG. 9 is a view similar to FIG. 7, illustrating the transport table in its stitching position.

The stapling system 30 also includes a paper transport assembly 80 (FIG. 3) which includes a flat horizontal support platform 79 projecting outwardly from the entry end wall 44 toward the associated collator 35 and alongside the distal end of the delivery chute 34 substantially coplanar with the top wall 47 of the cabinet 40. Formed in the top wall 47 is an elongated recessed well 81 (FIG. 2). Referring now also to FIGS. 5–10, fixedly secured to the top wall 47, respectively along opposite sides of the well 81, are two elongated guide rails 82, which extend outwardly onto the support platform 79. Respectively mounted on the guide rails 82 and projecting laterally inwardly therefrom are two elongated guide bars 83 (FIGS. 8 and 9).

A flat, generally rectangular transport table 85 overlies the support platform 79 and is adapted for reciprocating sliding movement along the guide bars 83. The transport table 85 is provided at its entry end with an elongated, generally rectangular end slot 86 (FIG. 5), and is provided along its outer side edge with a pair of longitudinally spaced-apart rectangular side slots 87. Integral with the inner side edge of the transport table 85 adjacent to the entry chute 84 is an upstanding retaining side wall 88. The inner side edge of the transport table 85 is also provided with a rectangular notch 88a at the leading corner thereof (FIG. 3). Fixedly secured to the underside of the transport table 85 are a pair of guide channels 89 (FIG. 3), respectively disposed for sliding engagement with the guide bars 83 to accommodate reciprocating sliding movement of the transport table 85 between a home position, illustrated in FIGS. 3, 7 and 10 and a stapling position, illustrated in FIG. 9.

The reciprocating movement of the transport table 85 is effected by a drive assembly 90 (FIG. 3). Referring now also to FIGS. 14–17, the drive assembly 90 includes an electric drive motor 91 carried by a mounting plate 92 (FIG. 17) in the lower part of the cabinet 40. The motor 91 has an output shaft 93 on which is fixedly secured a gear 94 disposed for meshing engagement with a gear 95 fixed to a shaft 96 for rotation therewith. Also fixed to the shaft 96 is one end of a crank arm 97, the other end of which is pivotally coupled, as at 98, to one end of an elongated link 99. The other end of the link 99 is pivotally coupled to an elongated drive arm 100 intermediate the ends thereof, by a pivot coupling 101. The lower end of the drive arm 100 is pivotally coupled to a pivot anchor 102 at the bottom of the cabinet 40, and the upper end thereof is pivotally coupled by a pivot pin 103 to an elongated vertical slot 104 (FIG. 10) in a coupling bracket 105 which is fixed to the underside of the transport table 85 at the leading end thereof. Also fixed to the shaft 96 are four control cams 106, 107, 108, and 109 (FIG. 17), which are disposed for respectively operating four control switches, as will be explained in greater detail below.

Figure 10:
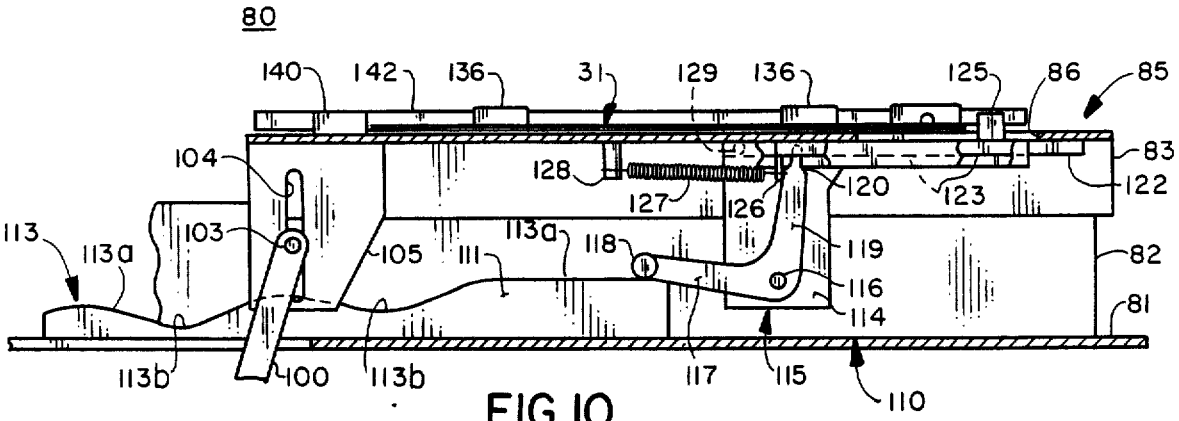
FIG. 10 is an enlarged, fragmentary view in partial vertical section of the transport table, shown in its home position, and illustrating the end jogger assembly.
Figure 11:
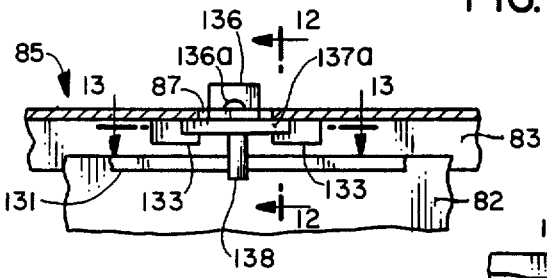
FIG. 11 is a fragmentary view in vertical section taken along the line 11—11 in FIG. 9, and illustrating one of the side jogger assemblies.
Figure 12:
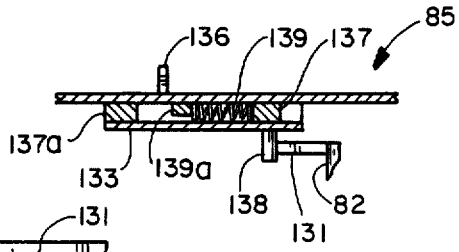
FIG. 12 is a fragmentary view in vertical section taken along the line 12—12 in FIG. 11.
Figure 14:
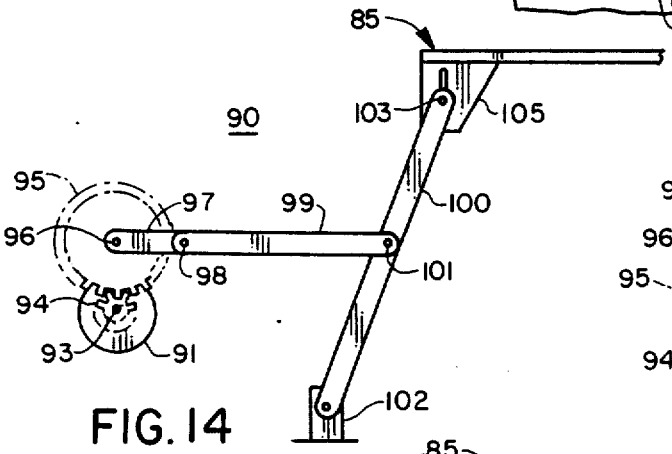
FIG. 14 is a fragmentary, side elevational view of the drive assembly for the transport table of the present invention, with the table in its home position.
Figure 15:
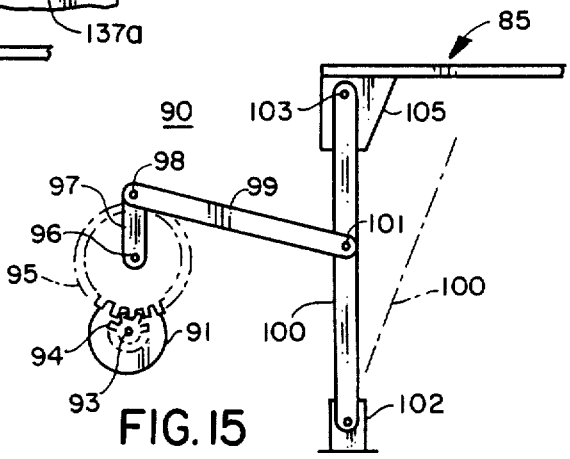
FIG. 15 is a view similar to FIG. 14, with the transport table illustrated between its home and stitching positions.
Figure 16:
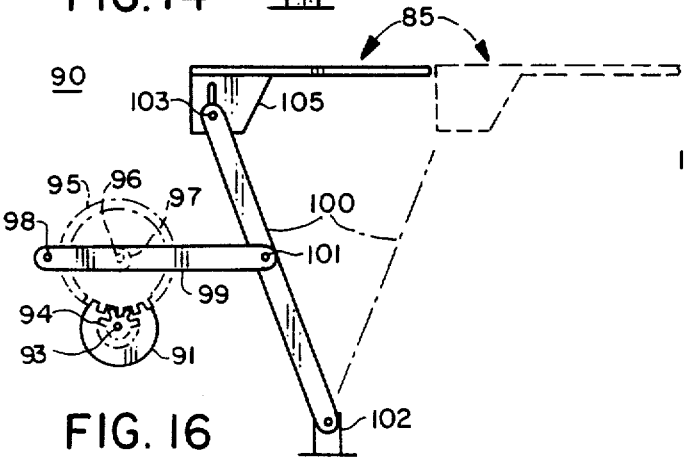
FIG. 16 is a view similar to FIG. 14, with the transport table illustrated in its stitching position.
Figure 17:
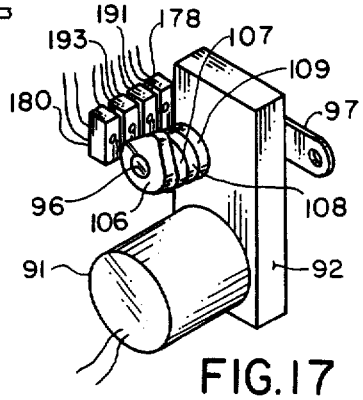
FIG. 17 is an enlarged, fragmentary, perspective view of the control cam portion of the drive assembly of FIGS. 14–16.

As the drive motor 91 is operated the transport table 85 will be moved from its home position, illustrated in FIGS. 10 and 14 through an intermediate position (FIG. 15) to a stapling position (FIG. 16) during the first half revolution of the shaft 96, and during the second half revolution the transport table 85 will be returned to its home position. The manner in which the operation of the drive motor 91 is controlled will be explained in greater detail below.

Mounted on the transport table 85 is an end jogger assembly 110. Referring to FIGS. 1 and 5–10, the end jogger assembly 110 includes an elongated cam rail 111 which is in the form of a vertically oriented plate, secured by mounting posts 112 to one side wall of the well 81 in the top wall 47 of the cabinet 40. The cam rail 111 has an undulating cam surface 113 along its upper edge defining peaks 113a and valleys 113b (FIG. 10). Fixedly secured to the bottom of the transport table 85 and depending therefrom is a support bracket 114 (FIG. 10), on which a drive member 115 is pivotally mounted by a pivot coupling 116. More specifically, the drive member 115 is generally L-shaped with the pivot 116 being at the vertex thereof, the drive member 115 having a forwardly extending arm 117 provided at its distal end with a cam follower roller 118 disposed for rolling engagement with the cam surface 113 of the cam rail 111. The drive member 115 also has an upwardly extending arm 119 provided at its distal end with a reduced tip 120 which is received in an associated socket in the underside of an elongated, generally rectangular, horizontal jogger plate 122, the opposite side edges of which are respectively disposed in guide brackets 123 fixedly secured to the transport table 85 to accommodate reciprocating sliding movement of the jogger plate 122.

The plate 122 has an elongated slot 124 (FIGS. 5 and 6) therethrough for receiving an associated fastener to secure in place an upstanding retaining wall or flange 125 which projects upwardly through the end slot 86 in the transport table 85 and above the upper surface thereof. Depending from the forward end of the jogger plate 122 is a pin 126 (FIG. 10) to which is fixedly secured one end of a helical tension spring 127, the other end of which is fixed to a pin 128 depending from the transport table 85 forwardly of the pin 126. Thus, it will be appreciated that the spring 127 resiliently biases the jogger plate 122 forwardly (to the left as viewed in FIG. 10) for holding the cam follower roller 118 in camming engagement with the cam surface 113.

Figure 13:
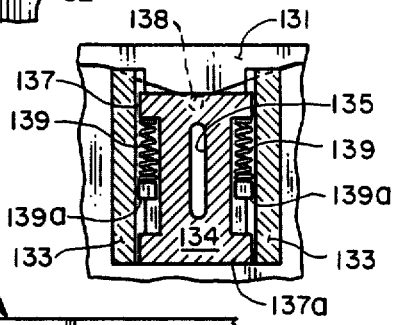
FIG. 13 is a fragmentary view in horizontal section taken along the line 13—13 in FIG. 11.

In operation, as the cam follower roller 118 enters valleys **113*a* in the undulating cam surface 113, the jogger plate 122 is moved forwardly, and as the cam follower roller 118 moves up peaks 113*b* in the cam surface 113 the jogger plate 122 is moved rearwardly. Accordingly, it can be seen that as the transport table 85 is moved forwardly from its home position illustrated in FIG. 10 to its stitching position illustrated in FIG. 13, a jogging reciprocating movement of the jogger plate 122 will be effected, thereby moving the retainer wall 125 back and forth along the end slot 86. The forward movement of the jogger plate 122 is limited by a stop pin 129 (FIG. 10) carried by one of the guide brackets 123. The peaks 113*a* and valleys 113*b* of the cam surface 113 get progressively lower from the home end to the stitching end thereof, so that when the transport table 85 arrives at its stitching position, the retainer wall 125 has moved into a position spaced from the end gate 140** a distance very slightly greater than the length of the paper being stapled.

Also carried by the transport table 85 are a pair of side jogger assemblies 130, which are substantially identical in construction so that only one will be described in detail. Referring to FIGS. 3 and 7–13, an elongated cam rail 131 is fixedly secured to the top wall 47, the cam rail 131 having an undulating cam surface 132 (FIGS. 7–9) including peaks **132*a* and valleys 132*b*. Each of the side jogger assemblies 130 includes a flat, horizontal jogger plate 134 (FIG. 13) which is generally I-shaped, being respectively provided adjacent to its opposite ends with transversely extending cross bars 137 and 137*a*. Formed in the jogger plate 134 is a longitudinally extending slot 135 (FIGS. 9 and 13) which facilitates mounting of an upstanding retainer wall or flange 136 by receiving a suitable fastener 136*a*. The opposite side edges of the jogger plate 134 are respectively slidably received in guide channels 133 affixed to the underside of the transport table 85, for accommodating reciprocating sliding movement of the jogger plate 134. Depending from the jogger plate 134 at its inner end is a cam follower 138 disposed for camming engagement with the cam surface 132. Respectively disposed in the guide channels 133 are a pair of helical compression springs 139, the forward ends of which bear against the ends of the forward cross bar 137*a*, and the rear ends of which bear against stops 139*a* carried by the guide channels 133 for resiliently urging the jogger plate 134 inwardly to hold the cam follower 138 in engagement with the cam surface 132**.

In operation, as the transport table 85 moves from its home position to its stitching position, the engagement of the cam follower 138 with the undulating cam surface 132 will cause a jogging, reciprocating movement of the retainer walls 136 of the side jogger assemblies 130 inwardly and outwardly of the transport table 85, this movement being accommodated by the side slots 87. It will be noted that the spacing of the peaks **132*a* and valleys 132*b* of the cam surface 132 are such that, when the transport table 85 is disposed in its home position, both of the cam followers 138 are disposed on peaks 132*a* (FIG. 7), so that the retaining walls 136 are held in their outermost positions to provide maximum room for receiving a stack 31 of paper. The parts are so arranged that, when the transport table 85 is disposed in its stitching position, the outer cross bars 137*a* of the jogger plates 134 will be stopped against the stops 139*a*, so that the cam followers 138 will be spaced a slight distance from the cam surface 132, to provide paper width adjustment despite backlash in the system. The peaks 132*a* and valleys 132*b* of the cam surface 132 get progressively lower from the home to the stitching end thereof, so that when the transport table 85 arrives at its stitching position, the retainer walls 136 have moved into a position spaced from the retainer side wall 88** a distance very slightly greater than the width of the paper being stapled.

Figure 22:
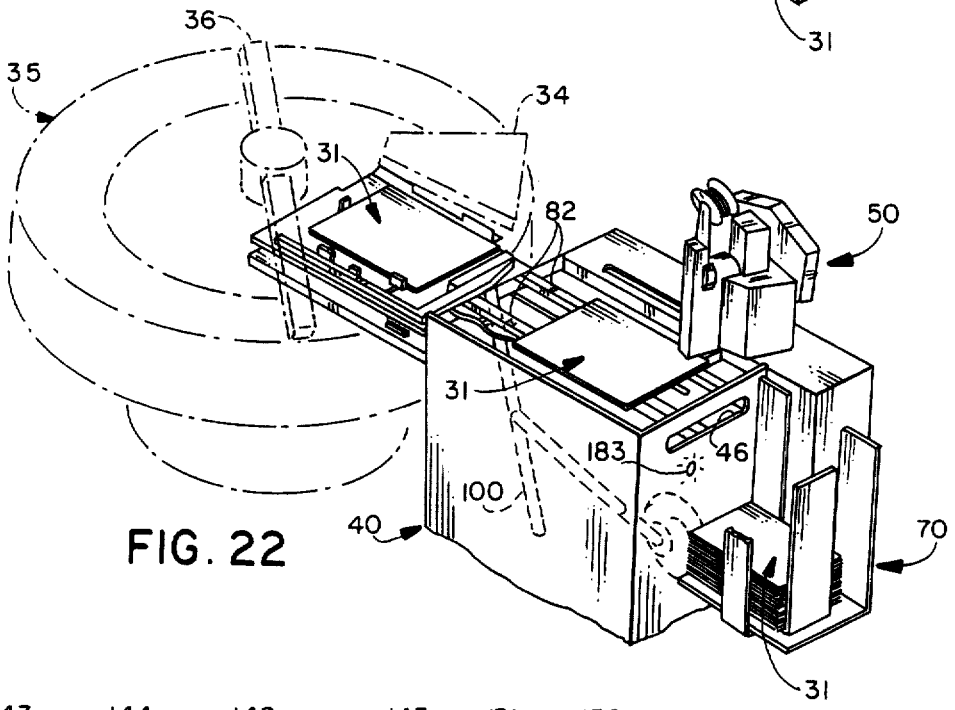
FIG. 22 is a view similar to FIG. 21, with the transport table returned to its home position and having received a new stack of papers.
Figure 23:
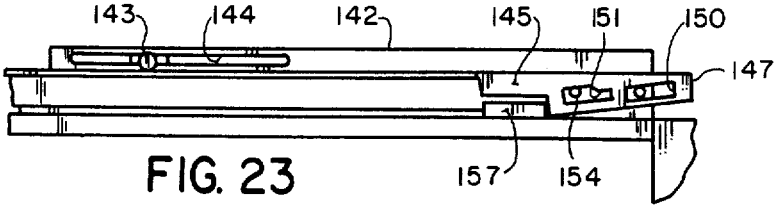
FIG. 23 is an enlarged, fragmentary, side elevational view of the end gate of the transport table and latching mechanism therefor, with the gate in its lowered position.
Figure 24:
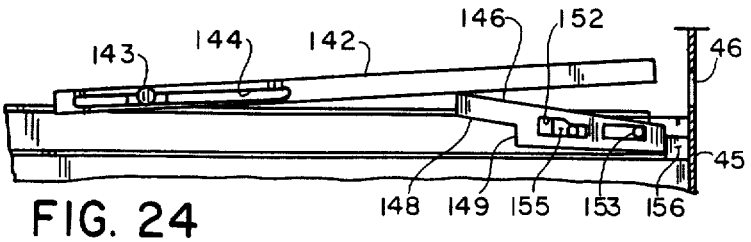
FIG. 24 is a view similar to FIG. 23, with the gate in its raised position.

Referring now to FIGS. 3, 5–9 and 18–24, the transport table 85 is provided with an end gate 140 which extends across the leading end thereof and is provided with an end retaining surface 141. The outer end of the end gate 140 is integral with an elongated side arm 142 which extends along the outer side edge of the transport table 85 toward the collator 35, being pivotally coupled to the transport table 85 by a pivot pin 143 which extends through an elongated adjustment slot 144 in the side arm 142. Disposed immediately beneath the leading end of the side arm 142 is a latch member 145 which has an upper lift surface 146, disposed for engagement with the side arm 142, and a leading end bearing surface 147 (FIGS. 23 and 24). The trailing end of the latch member 145 is provided with a notch 148 in its lower edge defining a bearing shoulder 149. Formed through the latch member 145 are two elongated openings 150 and 151, the latter having an enlarged lobe 152 at its trailing end. Respectively received through the openings 150 and 151 are pins 153 and 154, which are carried by a mounting block 155 secured to the underside of the transport table 85 at its leading end. Mounted on the inner surface of the exit end wall 45 of the cabinet 40, immediately above the top wall 47, is a lift block 156. Mounted on the top wall 47 adjacent to the entry end wall 44 is a release block 157.

In operation, when the transport table 85 is disposed in its home position, the end gate 140 is disposed in a lowered position, illustrated in FIGS. 3, 8 and 23, for providing an end stop for papers carried by the transport table 85. When the transport table 85 arrives at its stapling position (FIGS. 21 and 24), the end bearing surface 147 of the latch member 145 engages the lift block 156, pushing the latch member 145 rearwardly with respect to the transport table 85. This moves the pins 153 and 154 respectively to the forward ends of the openings 150 and 151, thereby tilting the latch member 145 upwardly to lift the side arm 142 and, thereby, the end gate 140. When the transport table 85 arrives back at its home position, the bearing shoulder 149 on the latch member 145 engages the release block 157, thereby driving the latch member 145 back forwardly with respect to the transport table 85 for again lowering the end gate 140 to the position illustrated in FIG. 23.

If desired, the transport table 85 may be provided with an air jet 158 (FIG. 3) intermediate the leading and trailing ends thereof along the outer side edge thereof for directing a stream of air across the upper surface of the transport table 85 to prevent the sheets 32 of a stack 31 from adhering together, thereby to facilitate the jogging positioning thereof, as will be explained more fully below. Air to the air jet 158 may be provided by a hose (not shown) which extends along the top wall 47 of the cabinet 40 and down through an opening therein, and thence to the air supply of the collator 35.

Figure 29:
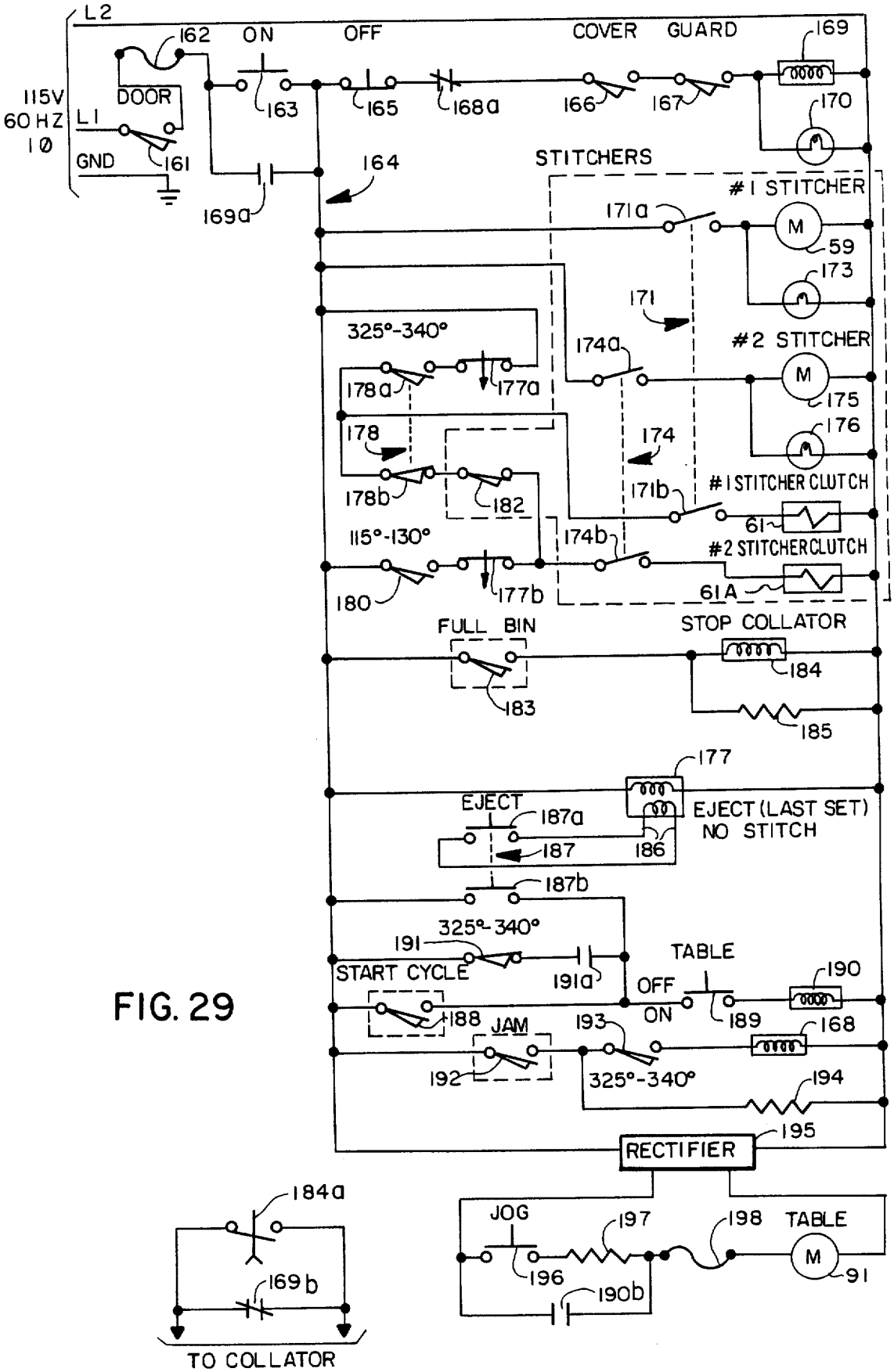
FIG. 29 is a schematic circuit diagram of the control circuit for the stapling system of FIGS. 1–3.

Referring now to FIG. 29, the operation of the stapling system 30 is controlled by a control circuit 160, housed within the control box 43. The control circuit 160 is coupled to lines L1 and L2 of a 115-volt, 60 Hz supply. The line L1 is coupled through the series combination of a door interlock switch 161, a fuse 162 and a push-button ON switch 163 to a line 164. The interlock switch 161 is normally-open and is closed by closure of the door (not shown) on the control box 43. The ON switch is located on a control panel disposed in a recess in the upper portion of the control box 43. Connected in series across the lines 164 and L2 are a normally-closed, manually-operated OFF switch 165, normally-closed contacts 168*a* of a control relay 168, a normally-open cover interlock switch 166, a normally-open guard interlock switch 67 and the coil of a control relay 169. The cover interlock switch 166 is closed by the closure of a clear plastic cover (not shown) over the top of the cabinet 40, and the guard interlock switch 167 is closed by the stitching machine 50A when used, or by a guard (not shown) which replaces the stitching machine 50A when not used. The control relay 169 has normally-open latching contacts 169*a* connected in parallel with the ON switch 163. An indicator lamp 170 is connected across the coil of the relay 169 to indicate that the system is on.

Connected in series across the lines 164 and L2 are one pole 171*a* of a manually-operated, double-pole, single-throw actuator switch 171, located on the stitching machine 50, and the drive motor 59 thereof. A lamp 173 is connected in parallel with the drive motor 59 to indicate when it is energized. Also connected in series across the lines 164 and L2 are one pole 174*a* of a manually-operated, double-pole, single-throw control switch 174 for the stitching machine 50A (if it is used), and the drive motor 175 thereof. An indicator lamp 176 is connected across the drive motor 175. Also connected in series across the lines 164 and L2 are the normally-closed contacts 177*a* of a paper-eject relay 177, a normally-open pole 178*a* of a double-pole, single-throw control switch 178 disposed for actuation by the cam 109 (FIG. 17) of the transport drive assembly 90, the other pole 171*b* of the stitching machine control switch 171 and the actuator solenoid 61 of the clutch assembly 60 of the stitching machine 50. Also connected in series across the lines 164 and L2 are a normally-open control switch 180 disposed for actuation by the cam 106, normally-closed contacts 177*b* of the paper eject relay 177, the other pole 174*b* of the stitching machine control switch 174 and an actuator solenoid 61A for the clutch assembly of the stitching machine 50A connected in series from the junction between the control switch pole 178*a* and the stitching machine control switch pole 171*b* and the junction between the relay contacts 177*b* and the stitching machine control switch pole 174*b* are a normally-closed pole 178*b* of the control switch 178 and a normally-closed limit switch 182, which is opened by the movement of the former 55 of the stitching machine 50 to its clamping position illustrated in FIG. 25.

Also connected in series across the lines 164 and L2 are a normally-open optical full bin switch 183 and the coil of a collator control relay 184, which has a resistor 185 connected thereacross. The coil of the paper eject relay 177 is also connected across the lines 164 and L2 and is provided with a pair of control terminals 186, across which are connected one pole 187*a* of a normally-open, double-pole, single-throw eject switch 187 which is mounted on the control panel and is manually operated. Also connected in series across the lines 164 and L2 are a normally-open optical cycle start switch 188 which is disposed on the transport table 85 (see FIG. 3), a manually-operated table ON/OFF switch 189, and the coil of a control relay 190. Connected in series across the cycle start switch 188 are a normally-closed control switch 191 disposed for actuation by the cam 108 and the normally-open latching contacts 190*a* of the control relay 190. Also connected in parallel with the cycle start switch 188 is the other pole 187*b* of the eject switch 187. Connected in series across the lines 164 and L2 are a normally-open jam limit switch 192, which is located on the transport table 85 (FIG. 3), a normally-open control switch 193 disposed for actuation by the cam 107 and the coil of the control relay 168. A resistor 194 is connected across the control switch 193 and the coil of the relay 168.

A rectifier 195 is connected across the lines 164 and L2 and has a pair of DC output terminals, across which are connected the series combination of a normally-open, manually-operated jog switch 196, a resistor 197, a fuse 198 and the drive motor 91 of the transport drive assembly 90. Normally-open latching contacts 190*b* of the relay 190 are connected across the jog switch 196 and the resistor 197.

It will be noted that the switches 183, 188 and 192 are optical switches, which draw a small amount of leakage current even in the open condition. When the system is operable, the coil of the control relay 190 is always connected in series with the switch 188 and has a sufficiently low impedance that it permits a path for this leakage current. However, the coil of the relay 184 in series with the switch 183 is of a different type which has a very high impedance. Therefor, the resistor 185 provides a path for the leakage current. While the coil of the control relay 168 in series with the switch 192 has a suitable resistance for providing a leakage path, it is normally open-circuited by the open control switch 193. Therefore, the resistor 194 provides the necessary leakage current path.

The control relay 169 has normally-closed contacts 169*b* which are connected across a control circuit for the collator 35 and which, in their normally closed condition, maintain the collator deenergized. Connected in parallel with the relay contacts 169*b* are normally-open contacts 184*a* of the relay 184.

Referring now generally to FIGS. 18–20 and 29, the operation of the stapling system 30 will be described in detail. Initially, the system is in a rest position, illustrated in FIG. 18, with the transport table 85 in its home position overlying the support platform 79 adjacent to the collator 35 and the stitching head 51 is in its normal rest position with the former 55 and staple driver 56 retracted. When it is desired to energize the stapling system 30, the control box door, cover and guard must first all be closed to close the interlock switches 161, 166 and 167. Then, when the ON switch 163 is momentarily closed, the control relay 169 is energized, closing its contacts 169*a* to latch the relay on, and opening its contacts 169*b* for releasing the interlock to the collator 35 and permitting the collator 35 to be operated. The stitching machine control switch 171 is then manually closed to energize the drive motor 59 of the stitching machine 50. If the stitching machine 50A is used, the control switch 174 is also manually closed to energize its drive motor 175. The table ON/OFF switch 189 is then closed to enable the paper transport assembly 80. The system is now energized and ready for the initiation of an operation cycle.

Figure 18:
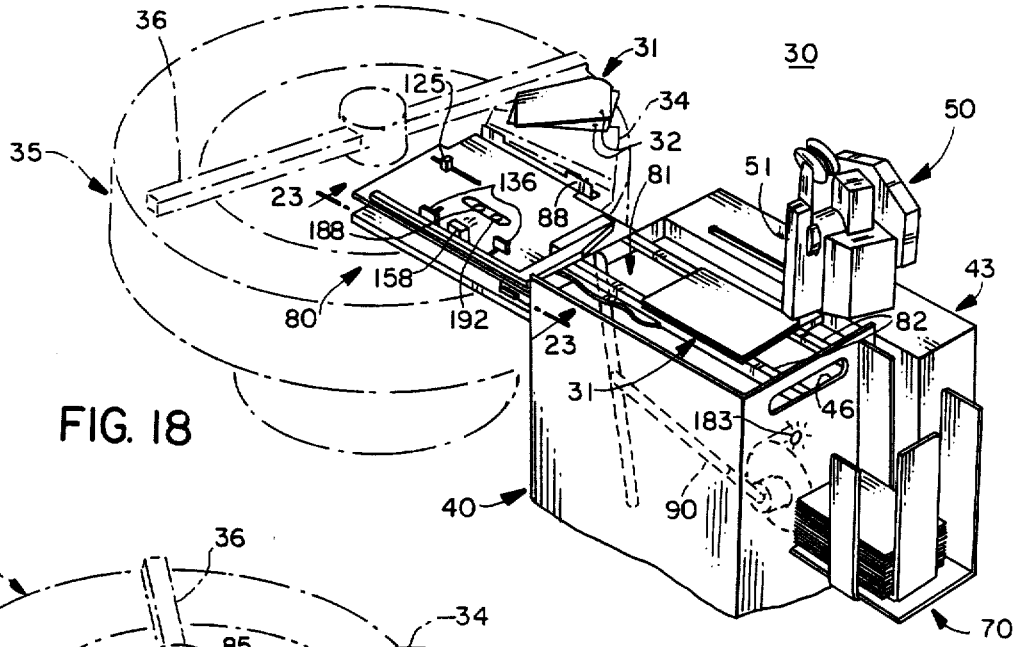
FIG. 18 is a view similar to FIG. 3, but slightly reduced, illustrating the paper transport assembly in its home position, with an already-stapled stack of papers at the stitching location, with the collection bin partially filled with stapled stacks of paper, and with a new stack of loose sheets about to be delivered onto the transport table.
Figure 19:
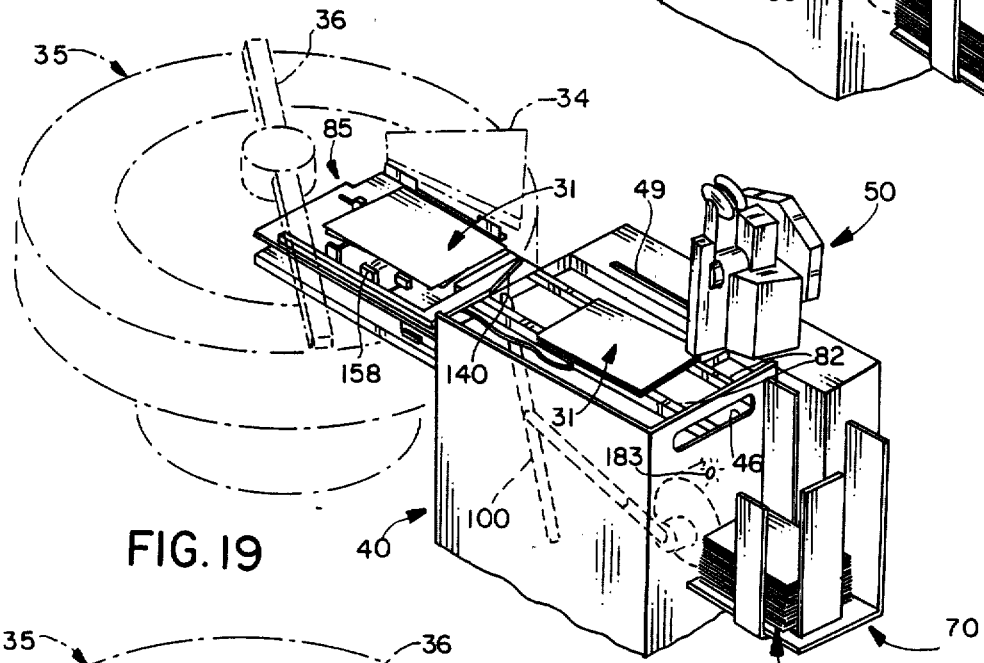
FIG. 19 is a view similar to FIG. 18, illustrating the stack of loose sheets after it has been delivered onto the transport table.

This cycle is initiated by the delivery of a stack 31 of loose sheets 32 onto the transport table 85 by the collator arm 36 (FIGS. 18 and 19). The stack 31 is deposited in a stack-receiving area of the transport table 85 between the retaining side wall 88 and the retainer walls 136 of the side jogger assemblies 130, and between the end gate 140 and the retainer wall 125 of the end jogger assembly 110. When the stack 31 is deposited in this stack-receiving area (see FIG. 19) it blocks the optical sensor for the cycle start switch 188 and the jam limit switch 192, closing those switches. Closure of the switch 188 energizes the control relay 190. Upon energization, the relay 190 is latched on by closure of its contacts 190*a*, and closure of its contacts 190*b* energizes the paper transport drive motor 91, for moving the transport table 85 from its home position to its stapling position.

Figure 25:
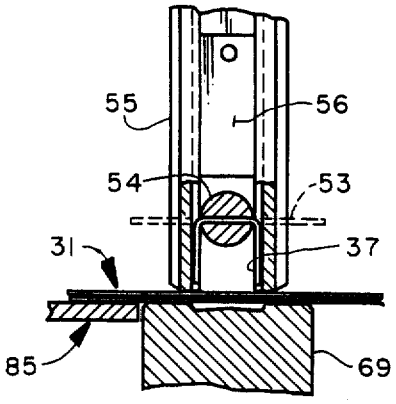
FIG. 25 is an enlarged, fragmentary view in vertical section taken along the line 25—25 in FIG. 27, and illustrating the stitching head with the former disposed in its forming position.
Figure 26:
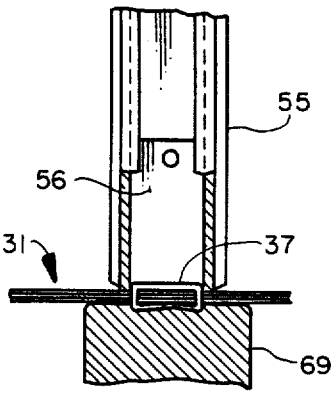
FIG. 26 is a view similar to FIG. 25, illustrating the staple driver in its driving position with the staple having been driven through the associated stack and clinched.

As explained above, during this movement, the end jogger assembly 110 reciprocates to jog the end edges of the sheets 32 in the stack 31 forwardly against the retaining surface 141 of the end gate 140. Similarly, as explained above, the side jogger assemblies 130 reciprocate to jog the outer side edges of the stack 31 against the retaining side wall 88. Thus, it will be appreciated that the jogger assemblies 110 and 130 cooperate to arrange the sheets 32 into a neat stack positioned at the inner front corner of the transport table 85. Referring in particular to FIG. 9, it can be seen that in this position, the front inner corner of the stack 31 overlies the notch 88*a* in the transport table 85. Thus, when the transport table 85 arrives at its stitching position, this overhanging edge of the stack 31 is received in the gap between the stitching head 51 and the anvil 69 of the stitching machine 50, as can be seen in FIGS. 25 and 27.

When the drive motor 91 has rotated through about 115 degrees of its first revolution, the control switch 180 is closed by the cam 106 and remains closed for about 15 degrees for momentarily energizing the clutch solenoid 61 of the stitching machine 50 through the relay contacts 177*b* and the switches 182, 178*b* and 171*b*. This will lift the actuator bar 62 (FIG. 28) to release the actuator collar 65 and engage the clutch for one-half revolution of the shaft 58 for moving the former 55 from its retracted position to its clamping position, illustrated in FIG. 25. The control switch 180 is actuated before the transport table 85 arrives at the stitching position to allow time for the stitching head 51 to react, so that the former 55 will arrive at its clamping position at substantially the same time that the transport table 85 arrives at its stitching position for clamping the stack 31 between the former 55 and the anvil 69, as explained above. Movement of the former 55 to its clamping position also serves to open the limit switch 182.

If the auxiliary stitching machine 50A is being used, the closure of the control switch 180 also serves to energize its clutch solenoid 61A for the stitching machine 50A through the relay contacts 177*b* and switch 174*b*. But in the clutch assembly of the stitching machine 50, the actuator collar 65 has only a single tang 67 thereon, thus when the clutch is engaged the shaft 58 will rotate through a complete revolution, driving the stitching head 51 of the stitching machine 50A through a complete cycle for stapling the stack 31 along its side edge. Reopening of the control switch 180 and opening of the limit switch 182, as described above, prevent reactivation of the solenoid 61A for initiating another cycle of the stitching machine 50A.

As the transport table 85 arrives at the stitching position, the latch member 145 will be driven backward by engagement with the lift block 156 for raising the end gate 140, as explained above and as illustrated in FIG. 24. Thus, when the transport table 85 returns to its home position, it will slide from under the stack 31, which will be held in the stitching position by the clamping action of the stitching head 51, the stack 31 simply resting upon the guide rails 82, as is illustrated in FIG. 22. As the transport table 85 moves out from beneath the stack 31, the optical cycle start switch 188 and jam switch 192 are uncovered and reopened.

During the return of the transport table 85 to its home position, when the shaft of the drive motor 91 has rotated through about 325 degrees of its initial revolution, the control switch 191 is opened by the cam 108 for deenergizing the control relay 190 which is latched deenergized through its reopened contacts 190*a*, and which also opens its contacts 190*b* to deenergizes the drive motor 91. The transport table 85 then coasts into its home position and, after about a further 15 degree rotation of the motor shaft the control switch 191 is reclosed. Simultaneously with the opening of the control switch 191, the control switch 178 is actuated by the cam 109 for opening its pole 178*b* and closing its pole 178*a*, to energize the clutch solenoid 61, and allow the shaft 58 of the of the stitching machine 50 to move through another half revolution to complete the second half of its cycle, driving the staple 37 through the stack 31 (FIG. 26) and then returning the stitching head 51 to its normal retracted condition. The control switch 178 also returns to its initial position after about 15 degrees rotation of the shaft 96 of the drive motor 91.

In the event that the paper should become jammed on the transport table 85, so that it does not release from the table 85 at the stitching location, it will continue to cover the optical start cycle switch 188 and jam switch 192 and hold them closed. Thus, the control relay 190 will remain energized and the motor 90 will continue running. But when the transport table 85 nears its home position, substantially simultaneously with the opening of the control switch 191, the control switch 193 is closed by the cam 107, thereby energizing the control relay 168 for opening its contacts 168*a*. This deenergizes the control relay 169, reopening its contacts 169*a* for deenergizing the stapling system 30, and reclosing its contacts 169*b* for stopping the collator 35. Thus, it will be appreciated, that the timing of the control switch 193 is such that the control relay 168 is not permitted to "see" the jam until the transport table 85 is nearly returned to its home position, so that when the system 30 is shut down the transport table 85 will coast back to its home position.

Figure 20:
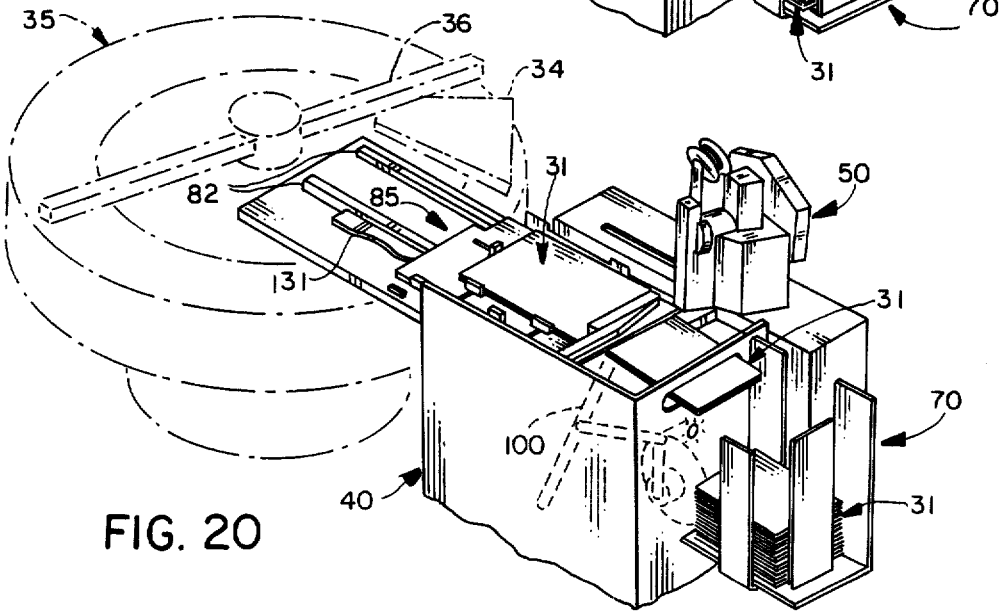
FIG. 20 is a view similar to FIG. 19, illustrating the transport table between its home and stitching positions pushing the previously-stapled stack of papers into the collection bin.
Figure 21:
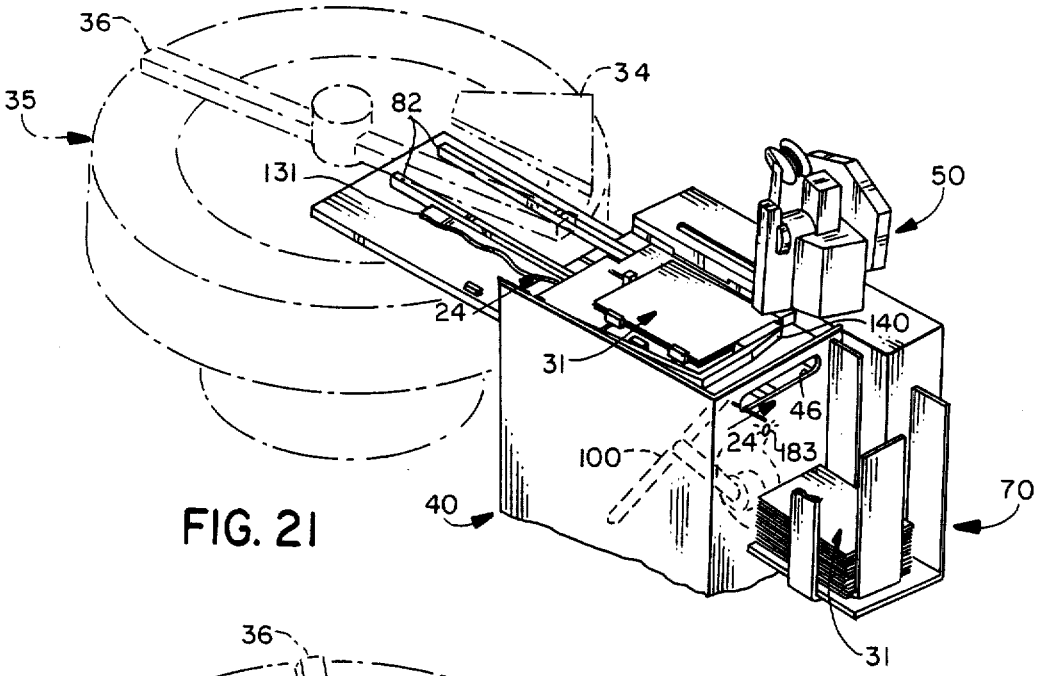
FIG. 21 is a view similar to FIG. 20, and illustrating the transport table in its stitching position.

After the transport table 85 has returned to its home position, the stapling system 30 is ready for the initiation of the next cycle, which begins with the deposit of the next stack 31 of sheets 32 onto the transport table 85 by the collator 35. As the transport table 85 moves to the stitching position during this next cycle, it will engage the stack 31 which was stapled during the previous cycle, and push it off the guide rails 82 through the exit slot 46 in the exit end wall 45 and into the bin 70, as is illustrated in FIGS. 19 and 20. When the bin 70 becomes full, the paper stacked therein will cover the optical limit switch 183, closing it to energize the relay 184, which then closes its contacts **184*a* to stop the collator 35 and prevent any additional stacks 31 from being delivered to the transport table 85. When this happens, the last-stitched stack will be left on the guide rails 82. In order to deposit it in the bin 70, the operator manually closes the eject switch 187. This energizes the relay 190 through the switch pole 187*b* to initiate another cycle of the transport table 85, for pushing the stapled stack into the bin 70. But closure of the switch 187 also energizes the relay 177 through the pole 187*a*, which in turn opens its contacts 177*a* and 177*b* to prevent actuation of the clutch solenoids 61 and 61A of the stitching machines 50 and 50A. Thus, in the event that there is a stack 31 on the transport table 85, it will not be released at the stitching location and will not be stitched, but will simply be carried back to the home position. Then, as soon as the bin 70 is emptied, the optical switch 184 reopens, deenergizing the relay 184 and allowing restarting of the collator 35. If there is already a stack 31 on the transport table 85, its presence there will immediately initiate the next cycle of operation of the stapling system 30**.

At times, it may be desirable to test the operation of the stapling system 30 without the presence of any paper thereon, or when the collator 35 is not operating. For this purpose, the jog switch 196 is provided. It can be seen that the drive motor 91 will be energized for as long as the jog switch 196 is held closed, so that the motor 91 can be moved through any desired portion of its rotational cycle. The resistor 197 reduces the current flow to the motor 91, causing it to run slower during this testing operation to facilitate observation of the operation of the stapling system 30.

Figure 4:
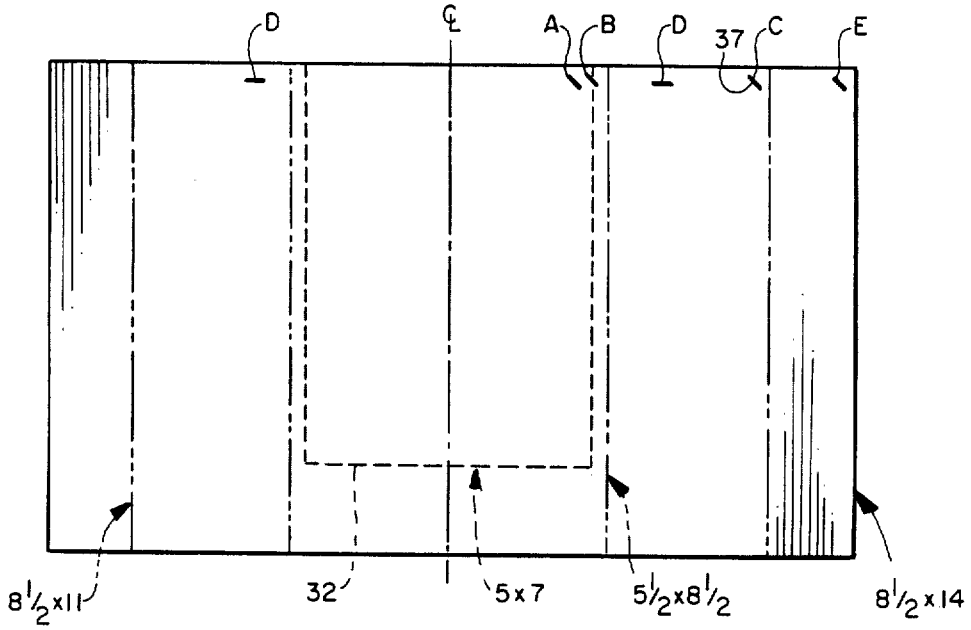
FIG. 4 is an enlarged, diagrammatic, top plan view of stapling configurations which can be effected by the stapling system of FIGS. 1–3 for different size sheets of paper.
Figure 5:
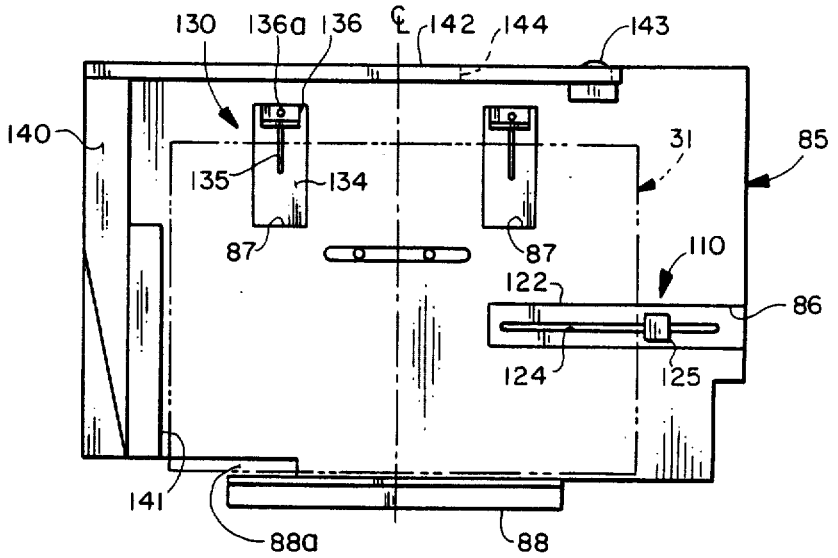
FIG. 5 is an enlarged, top plan view of the transport table of the stapling system of FIGS. 1–3, showing the settings of the jogger assemblies for letter-size paper.
Figure 6:
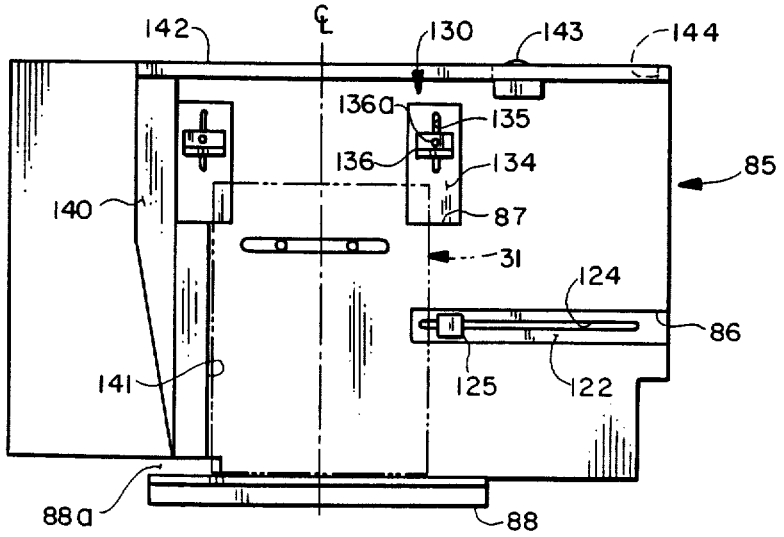
FIG. 6 is a view similar to FIG. 5, illustrating the configuration of the parts for 5-inch×7-inch paper.
Figure 7:
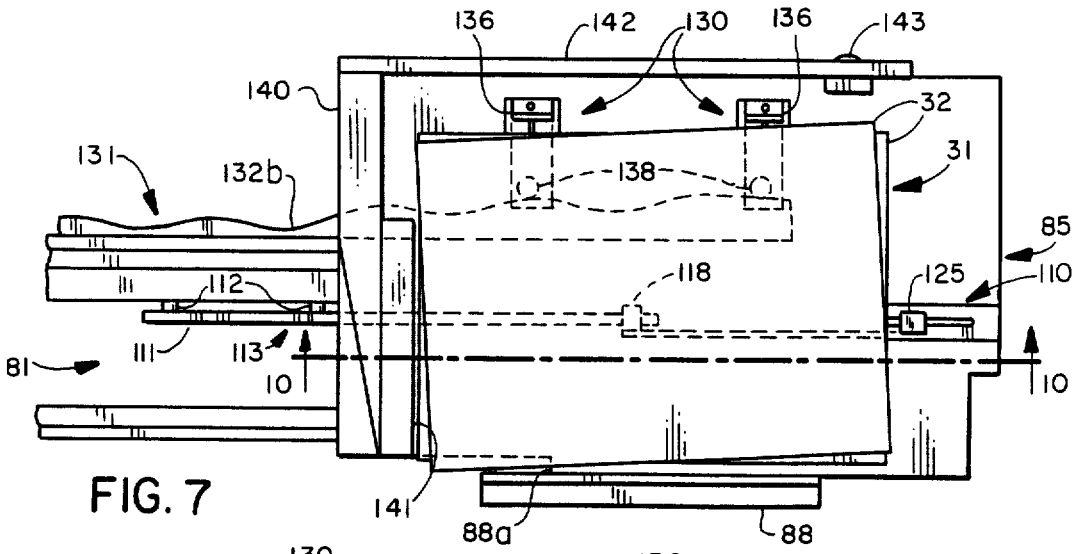
FIG. 7 is an enlarged, fragmentary, top plan view of the paper transport assembly of the stapling system of FIGS. 1–3, with the transport table illustrated in its home position.

As explained above, the bin 70 and the jogger assemblies 110 and 130 are adjustable to accommodate different size sheets of paper. FIG. 4 illustrates the stapling formats useful with several different size sheets. In the case of 5-inch × 7-inch paper, only the stitching machine 50 would be used and it would be inclined at an angle, as illustrated in FIGS. 1–3, for driving a single angled staple through the corner of the stack at the position A, in FIG. 4. Similarly, for 5½-inch × 8½-inch paper, a single corner staple will be used at the position B. In the case of 8½-inch × 11½-inch paper, either a single corner staple can be used at the position C or, alternatively, the auxiliary stitching machine 50A may also be used, and the stitching machine 50 will be rotated in the slot **49*a* (FIG. 2) to the same orientation as the stitching machine 50A for driving a pair of staples at spaced-apart locations along the side edge of the stack, as indicated at D. Similarly, for 8½-inch × 14-inch paper, either a single corner staple can be used at position E or a pair of side staples at positions D. While not illustrated, paper widths up to 9 inches may be accommodated in the stapling system 30**.

From the foregoing, it can be seen that there has been provided an improved stapling system which is uniquely adapted for use with an associated collator, such as a rotary collator, which serves to jog the collated stacks into neat, accurately-positioned stacks for stapling, and which utilizes existing stapling machines in an efficient, and relatively inexpensive stapling operation.

We claim:

1. A wire stapling apparatus for forming a length of wire into a staple and driving it through a stack of sheets, said apparatus comprising: a clincher anvil, a stapling head spaced a predetermined distance from said anvil and cooperating therewith to define a gap therebetween, a transport table having a generally rectangular stack-receiving area bounded at opposite ends thereof respectively by first and second end retaining means and bounded at opposite sides thereof respectively by first and second side retaining means, drive means for effecting movement of said transport table between a receiving location for receiving an associated stack of loose sheets into said stack-receiving area and a stapling location wherein at least a portion of the stack is disposed in said gap; at least said first end retaining means and said first side retaining means being movable in jogging movements repeatedly toward and away from the adjacent edge of the stack for jogging the loose sheets into a neat stack with the sheets vertically aligned and engaging said second end retaining means and said second side retaining means, actuating means responsive to movement of said transport table from the receiving location to the stapling location for actuating said first end and side retaining means into their jogging movements, said head including forming means movable between retracted and forming positions for forming a length of wire into a generally inverted U-shaped staple, said forming means in its forming position cooperating with said anvil firmly to clamp therebetween a stack of sheets disposed on said transport table at the stapling location, staple driving means movable between retracted and stapling positions for driving the associated staple through the stack of sheets and into engagement with said anvil, motive means for moving said forming means between its retracted and forming positions and for moving said staple drive means between its retracted and stapling positions, and staple control means coupled to said motive means for controlling the operation thereof, said staple control means delaying the movement of said staple driving means to its stapling position for a predetermined time period after movement of said forming means to its forming position and thereafter moving said forming means and said staple driving means back to their retracted positions.

2. The apparatus of claim 1, and further comprising a collator disposed at the receiving location for arranging loose sheets into a stack and delivering the stack into said stack-receiving area of said transport table.

3. The apparatus of claim 2, and further comprising a collection bin for receiving stapled stacks of sheets, said transport table being operative during movement from the receiving location to the stapling location for pushing a previously-stapled stack from the stapling location into said bin.

4. The apparatus of claim 3, and further comprising collator control means coupled to said collator and to said bin and responsive to filling of said bin for stopping said collator.

5. The apparatus of claim 1, and further comprising table control means coupled to said drive means and responsive to receipt of a stack of loose sheets into said stack-receiving area for effecting movement of said transport table from the receiving location to the stapling location and back to the receiving location.

6. The apparatus of claim 1, wherein said transport table includes gate means movable between a retaining position for retaining a stack of sheets on said transport table and a release position for releasing the stack of sheets from said transport table, and further comprising gate control means responsive to movement of said transport table to the stapling location for moving said gate means from its retaining position to its release position and responsive to movement of said transport table to the receiving location for moving said gate means from its release position to its retaining position.

7. The apparatus of claim 1, wherein said stapling head is disposed adjacent to a corner of the stack, said stapling head being movable between inclined and parallel positions for respectively driving staples at an angle to or parallel to the side edge of the stack, and further comprising an auxiliary stapling head disposed at the stapling location and spaced from the first stapling head longitudinally of the side edge of the stack for driving a second staple therethrough.

8. A wire stapling apparatus for forming a length of wire into a staple and driving it through a stack of sheets, said apparatus comprising: a clincher anvil; a stapling head spaced a predetermined distance from said anvil and cooperating therewith to define a gap therebetween; and reciprocating transport means for delivering a stack of loose sheets to a stapling location with at least a portion of the stack disposed in said gap; said head including forming means movable between retracted and forming positions for forming a length of wire into a generally inverted U-shaped staple, said forming means in its forming position cooperating with said anvil firmly to clamp the stack of sheets therebetween, staple driving means movable between retracted and stapling positions for driving the associated staple through the stack of sheets and into engagement with said anvil, motive means for moving said forming means between its retracted and forming positions and for moving said staple driving means between its retracted and stapling positions, and control means coupled to said motive means for controlling the operation thereof, said control means delaying the movement of said staple driving means to its stapling position for a predetermined time period after movement of said forming means to its forming position and thereafter moving said forming means and said staple driving means back to their retracted positions.

9. The apparatus of claim 1, wherein said motive means includes a rotatable shaft, said control means being operable so that said forming means and said staple driving means move from their retracted positions respectively to their forming and stapling positions and back to their retracted positions in one complete revolution of said shaft.

10. The apparatus of claim 9, wherein said control means includes clutch means coupled to said shaft and operable between an engaged condition for permitting rotation of said shaft and a disengaged condition for preventing rotation of said shaft, and clutch actuation means for periodically actuating said clutch means to its engaged condition for a time period sufficient to permit rotation of said shaft through about 180 degrees.

11. The apparatus of claim 1, and further comprising means for moving said transport means from a stack-receiving location to the stapling location and back to the stack-receiving location.

12. The apparatus of claim 11, wherein said transport means includes gate means movable between a retaining position for retaining a stack of sheets on said transport means and a release position for releasing the stack of sheets from said transport means, and further comprising gate control means responsive to movement of said transport means to the stapling location for moving said gate means from its retaining position to its release position and responsive to movement of said transport means to the stack-receiving location for moving said gate means from its release position to its retaining position.

13. The apparatus of claim 12, wherein said gate control means includes latch mechanism carried by said gate means, and two latch actuators respectively disposed at the stack-receiving location and the stapling location for engagement with said latch mechanism for controlling the operation of said gate means.

14. A stapling apparatus comprising: a stapling head for driving a staple through an associated stack of sheets, a transport table having a generally rectangular stack-receiving area bounded at opposite ends thereof respectively by first and second end retaining means and bounded at opposite sides thereof respectively by first and second side retaining means, drive means for effecting movement of said transport table between a receiving location for receiving an associated stack of loose sheets into said stack-receiving area and a stapling location wherein the stack is disposed for being stapled by said stapling head, at least said first end retaining means and said first side retaining means being movable in jogging movements repeatedly toward and away from the adjacent edge of the stack for jogging the loose sheets into a neat stack with the sheets vertically aligned and engaging said second end retaining means and said second side retaining means, and actuating means responsive to movement of said transport table from the receiving location to the stapling location for actuating said first end and side retaining means into their jogging movements.

15. The apparatus of claim 7, wherein said actuating means includes elongated cam rails disposed along the path between the receiving location and the stapling location, and cam follower means carried by said first end and side retaining means for camming engagement with said cam rails.

16. The apparatus of claim 15, wherein said cam rails defined first and second cam surfaces, said cam follower means including first and second followers respectively carried by said first end retaining means and said first side retaining means and being respectively disposed in camming engagement with said first and second cam surfaces.

17. The apparatus of claim 16, wherein said first and second cam surfaces are substantially perpendicular to each other.

18. The apparatus of claim 14, and further comprising two of said first side retaining means spaced apart longitudinally of said transport table.

19. The apparatus of claim 14, wherein each of said first end and side retaining means is adjustable for accommodating different size sheets.

20. The apparatus of claim 14, wherein said drive means includes a rotary motor having a rotated output shaft, and linkage means coupling said output shaft to said transport table for converting the rotary motion of said output shaft to a reciprocating motion of said transport table.

21. The apparatus of claim 14, and further comprising control means coupled to said drive means and responsive to receipt of a stack of loose sheets into said stack-receiving area for effecting movement of said transport table from the receiving location to the stapling location and back to the receiving location.

* * * * *

UNITED STATES PATENT AND TRADEMARK OFFICE

CERTIFICATE OF CORRECTION

PATENT NO. : 4,932,579

DATED : June 12, 1990

INVENTOR(S) : Simonelic, et al.

It is certified that error appears in the above-identified patent and that said Letters Patent is hereby corrected as shown below:

Column 15, line 58, change "claim 1" to --claim 8--.

Column 16, line 5, change "claim 1" to --claim 8--;

line 50, change "claim 7" to --claim 14--.

Signed and Sealed this

Twenty-seventh Day of August, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,932,579

DATED : June 12, 1990

INVENTOR(S) : Simonelic, et al.

It is certified that error appears in the above-identified patent and that said Letters Patent is hereby corrected as shown below:

Column 15, line 58, change "claim 1" to --claim 8--.

Column 16, line 5, change "claim 1" to --claim 8--;

line 50, change "claim 7" to --claim 14--.

Signed and Sealed this

Twenty-seventh Day of August, 1991

*Attest:*

HARRY F. MANBECK, JR.

*Attesting Officer*

*Commissioner of Patents and Trademarks*